US007481065B2

(12) United States Patent
Krieger

(10) Patent No.: US 7,481,065 B2
(45) Date of Patent: Jan. 27, 2009

(54) EXPANDABLE COOLER

(75) Inventor: Michael Krieger, Miami Beach, FL (US)

(73) Assignee: Vector Products, Inc., Ft. Lauderdale, FL (US)

( * ) Notice: Subject to any disclaimer, the term of this patent is extended or adjusted under 35 U.S.C. 154(b) by 102 days.

(21) Appl. No.: 11/147,363

(22) Filed: Jun. 8, 2005

(65) Prior Publication Data

US 2005/0268622 A1 Dec. 8, 2005

Related U.S. Application Data

(60) Provisional application No. 60/577,574, filed on Jun. 8, 2004.

(51) Int. Cl.
*F25B 21/02* (2006.01)

(52) U.S. Cl. ..... 62/3.6; 62/457.1

(58) Field of Classification Search ..... 62/3.6, 62/3.62, 457.1, 457.9
See application file for complete search history.

(56) References Cited

U.S. PATENT DOCUMENTS

| | | | | |
|---|---|---|---|---|
| 3,633,381 | A * | 1/1972 | Haaf et al. | 62/222 |
| 4,858,444 | A * | 8/1989 | Scott | 62/372 |
| 5,285,656 | A | 2/1994 | Peters | |
| 5,660,310 | A | 8/1997 | LeGrow | |
| 5,772,066 | A | 6/1998 | Reynolds | |
| 5,971,200 | A | 10/1999 | Reynolds | |
| 6,308,518 | B1 | 10/2001 | Hunter | |

* cited by examiner

*Primary Examiner*—Melvin Jones
(74) *Attorney, Agent, or Firm*—Venable LLP; Jeff Kaminski

(57) ABSTRACT

An expandable cooler is provided. The cooler includes an insulating portion defining a storage cavity and an expandable portion defining a second storage cavity. The expandable portion is adapted to move between an open and a closed position. The expandable portion may be fixedly attached to the insulated portion. In a further embodiment, a telescoping handle is attached to the cooler. A hook is provided on the telescoping handle and is adapted to be received in a corresponding slot in the expandable portion. The expandable portion may be moved between the open and closed position via the handle.

25 Claims, 4 Drawing Sheets

EXPANDABLE COOLER

CROSS REFERENCE TO RELATED APPLICATIONS

This application claims priority form U.S. Provisional Application Ser. No. 60/577,574, filed Jun. 8, 2004, which is incorporated herein by reference.

BACKGROUND OF THE INVENTION

1. Field of the Invention

The present invention relates generally to an expandable storage device.

2. Related Art

Today's active lifestyle requires that people be able to handle many different tasks at the same time. Not only has multi-tasking become commonplace, it has been taken to the next level with "hyper-tasking." Today's busy professionals and homemakers are required to perform many tasks and run errands at the same time. For example, a trip to the grocery story may be combined with trips to the dry cleaners, soccer practice, or other activities. During these different trips, the refrigerated or frozen goods purchased at the grocery store may be left in a vehicle for an extended period of time and may melt or become spoiled. Such refrigerated or frozen goods could be stored in a conventional cooler, however the cooler would need to be separately loaded and unloaded from the rest of the dry goods purchased at the grocery store.

Additionally, during outings to the beach, picnics, boat excursions, etc., there is a need to easily store and transport both items that require refrigeration and dry goods. As mentioned above, one trip is required to carry the items in the cooler or the cooler itself, while separate trips are required for the dry goods. Thus, there is a need for a device that can keep refrigerated or frozen goods cool and prevent them from spoiling or melting and that can also store and transport dry goods in a single, easy to handle container.

SUMMARY OF THE INVENTION

An expandable cooler is provided. The cooler includes an insulating portion defining a storage cavity and an expandable portion defining a second storage cavity. The expandable portion is adapted to move between an open and a closed position. The expandable portion may be fixedly attached to the insulated portion. In a further embodiment, a telescoping handle is attached to the cooler. A hook is provided on the telescoping handle and is adapted to be received in a corresponding slot in the expandable portion. The expandable portion may be moved between the open and closed position via the handle.

In another embodiment of the invention, the expandable storage device, comprises a housing defining a first storage compartment being at least partially insulated; an expandable housing adjacent to the housing and defining a second storage compartment; a common wall separating the first storage compartment from the second storage compartment, the expandable housing being movable between a closed position in which the expandable housing is moved towards the common wall and an expanded position in which the expandable housing is moved away from the common wall with respect to the closed position to expand the second storage compartment.

In another embodiment of the invention, the expandable storage device, comprises a housing having a hard shell defining an insulated compartment, the housing including first and second sections that are movable apart from each other; side walls extending between the first and second sections of the housing; a bottom connected to the side walls, the side walls and the bottom defining a second compartment disposed between the two sections of the housing, the side walls adapted to collapse when the first and section sections of the housing are moved towards each other.

In another embodiment of the invention, the expandable storage device, comprises a bottom having a plurality of side edges; insulated side walls extending in the same direction from all but one of the side edges of the bottom, the insulated side walls immediately adjacent to each other being connected together; a common wall extending from the one side edge of the bottom in the same direction as and connected to the insulated side walls to define a first storage compartment with the bottom and insulated side walls; an end wall; at least two expandable walls arranged opposite each other and extending from a surface of the common wall opposite the first storage compartment to the end wall; a bottom connected to the expandable walls and the end wall to define a second storage compartment, the end wall being movable with respect to the common wall.

Further objectives and advantages, as well as the structure and function of exemplary embodiments will become apparent from a consideration of the description, drawings, and examples.

BRIEF DESCRIPTION OF THE DRAWINGS

The foregoing and other features and advantages of the invention will be apparent from the following, more particular description of an exemplary embodiment of the invention, as illustrated in the accompanying drawings wherein like reference numbers generally indicate identical, functionally similar, and/or structurally similar elements.

DETAILED DESCRIPTION OF A PREFERRED EMBODIMENT OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention.

An expandable storage device is provided. In an exemplary embodiment, the expandable storage device is a cooler. The cooler includes an insulated portion that may be used to store hot and/or cold items. The cooler includes an expandable storage system. The cooler with the expandable storage system may be adapted to fit in the rear cargo area of a minivan or sport utility vehicle (SUV). Perishable items may be stored in the insulated portion and dry goods or non-perishable items may be stored in the expandable storage portion. The insulated portion may be provided with a heating/cooling system to maintain the interior of the insulated portion at or near a desired temperature. The heating/cooling system may include a conventional compressor/coil core or a thermoelectric heater/cooler, both of which are known to those of ordinary skill in the art. A rechargeable power supply and associated circuitry, such as a rechargeable battery and recharging circuit, may also be provided for the cooling system.

Figure 1:
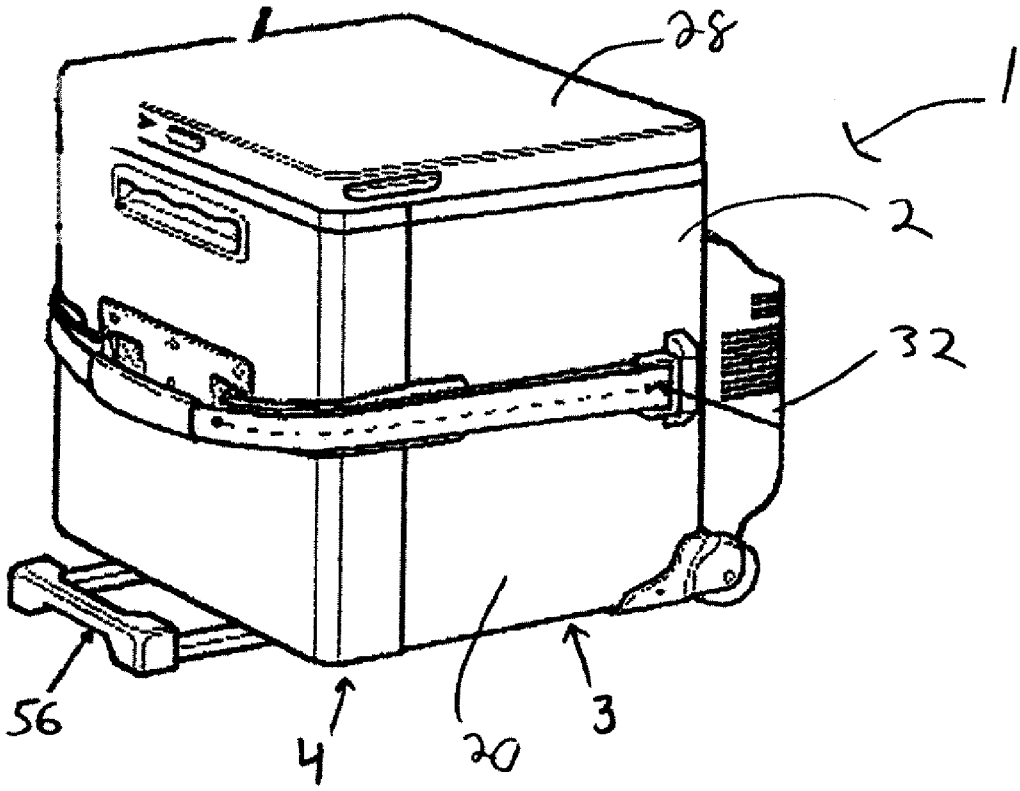
FIG. 1 depicts an exemplary embodiment of an expandable cooler according to the present invention.
Figure 2:
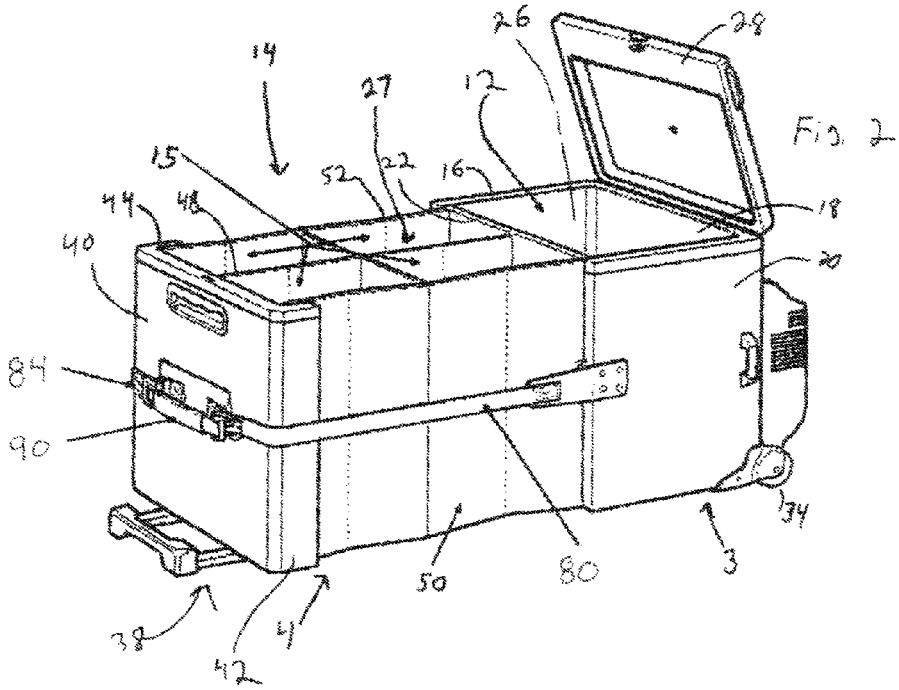
FIG. 2 depicts another exemplary embodiment of an expandable cooler according to the present invention.

FIGS. 1-4 illustrate an exemplary embodiment of the present invention. In the illustrated embodiment, an expandable cooler is provided. The expandable cooler 1 includes a housing 2. The housing 2 may be divided into two or more sections, such as first and second sections 3, 4. First and second sections 3, 4 may be movable with respect to each other to provide additional storage space, as shown in FIG. 2.

The expandable cooler 1 includes an insulated portion 12 having an expandable storage portion 14 adjacent thereto. The insulated portion 12 includes walls 16, 18, 20, 22 extending from a bottom 24 to define a storage cavity 26. A lid 28 may also be provided to selectively cover the storage cavity 26. The lid 28 may be attached by hinges (not shown) or other means to at least one of the walls 16-22 in a known manner. The lid 30 may be held in place to secure any items that are stored within the storage cavity 26.

In this embodiment walls 16-20 and bottom 24 comprise first section 3 of the housing. As shown in FIG. 2, the wall 22 is a common wall between the insulated portion 12 and the expandable portion 14. At least one of the walls of first section 3 may be made of an insulated material, for example a material similar to that used in typical coolers, such as insulated metal or plastic.

Figure 3:
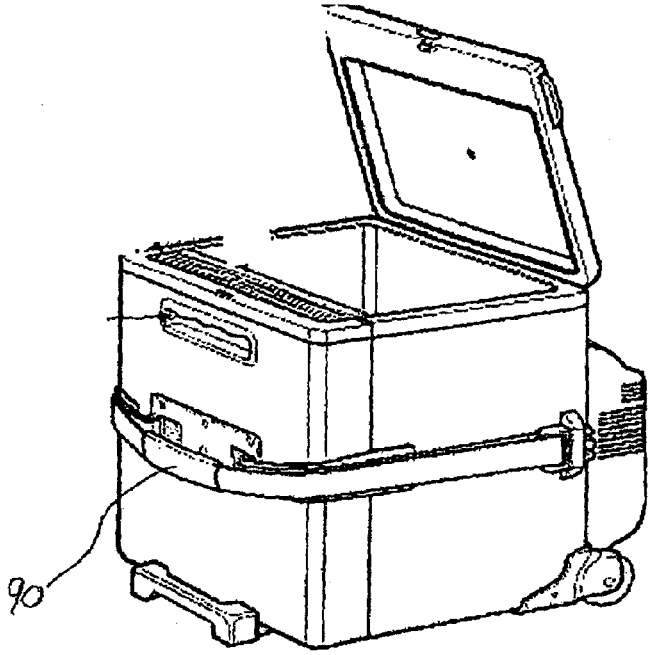
FIG. 3 depicts yet another exemplary embodiment of an expandable cooler according to the present invention.
Figure 4:
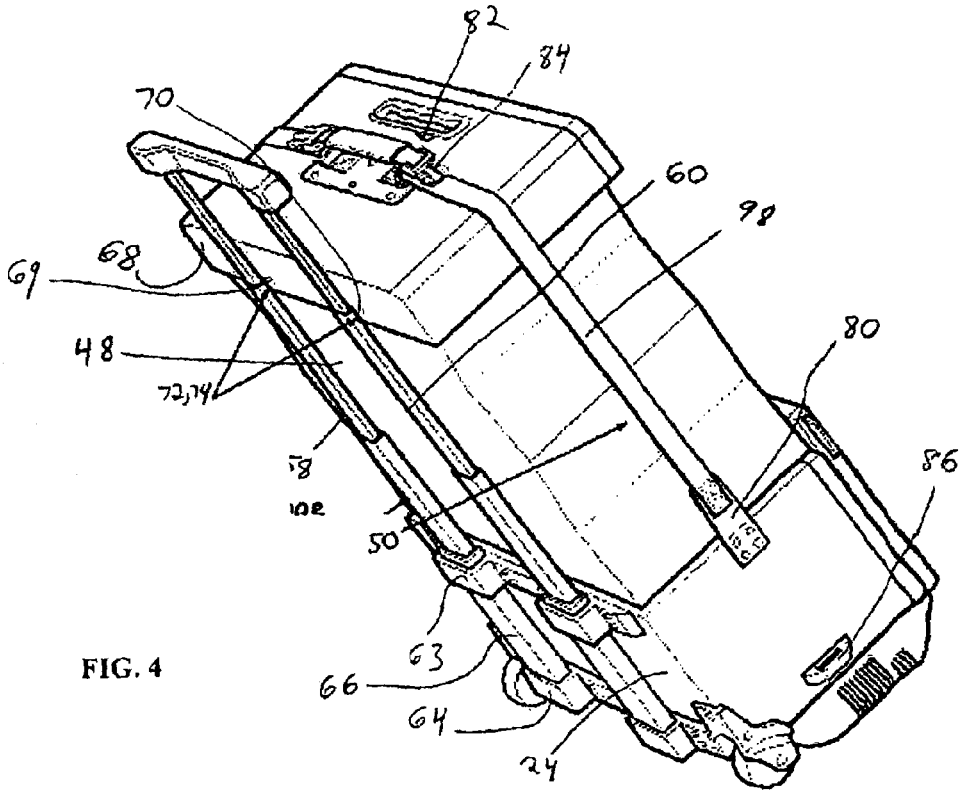
FIG. 4 depicts a further exemplary embodiment of an expandable cooler according to the present invention.

The second section 4 of the housing 1 is comprised of an end wall 40. The second section 4 may be moveable with respect to common wall 22 to create a storage space 27 in the expandable portion 14. The expandable portion 14 is adjacent to the insulated portion 12. The expandable portion 14 is adapted to be moved between an expanded position and a closed position. FIGS. 1 and 3 illustrate the expandable portion 14 in a closed position. FIGS. 2 and 4 illustrate the expandable portion 14 in an expanded position.

As best shown in FIG. 2 the common wall 22 divides the expandable portion 14 from the insulated portion 12. The expandable portion 14 is defined in part by the end wall 40 with two side sections 42, 44 attached to the end wall 40. The side sections 42, 44 are adjacent to the walls 16, 20 of the insulated portion 12 when the expandable portion 14 is in its closed position, as can be seen in FIGS. 1 and 3. The end wall 40 and side sections 42, 44 of the expandable portion 14 may be constructed of material similar to that of the walls of the insulated portion 12 or merely have a similar appearance so that the cooler has a uniform look.

In the expanded position, two side walls 50, 52, the common wall 22, bottom 48 and end wall 40 of the expandable portion 14 define second storage cavity 27, as best seen in FIGS. 2 and 4. One or more dividers 48 may also be provided to divide the storage compartment 27 into a number of smaller spaces 15. Various dry goods or other items may be stored in the storage portion. FIGS. 2 and 4 illustrate the expandable portion 14 in its expanded position. The side walls 50, 52 are arranged opposite each other and extend from the common wall 22, to an end wall 40. A bottom 48, extends between the common wall with the insulated portion and the end wall 40 and between the side walls 50, 52.

The side walls 50, 52 may be attached to the side sections 42, 44. The side walls 50, 52 and bottom 48 may be made of a heavy nylon cloth material. The side walls 50, 52 and bottom 48 may be adapted to fold up accordion style or otherwise compress when the expandable portion 14 is moved to the closed position. The common wall 22 between the expandable portion 14 and the insulated portion 12 is preferably made of a soft, insulated material. For example, the common wall may be made of a soft insulating material that is covered by nylon.

When the expandable portion 14 is in the closed position, the lid 28 may cover both of the insulated portion 12 and the expandable portion 14, as is shown in FIG. 1. A lock, latch, or the like may be provided to hold the lid closed. The latch may be provided on an underside of the lid 28. A corresponding surface to receive and engage the latch is provided in a top surface 60 of the end wall 40. A release is provided to release the latch. The latch release may be, for example, a button provided on the lid 28. The lid 28 can be opened to provide access to the storage cavity 26. When the lid 28 is closed and secured in place, the latch also serves to prevent the expandable portion 14 from moving from the closed position to the expanded position.

The second storage cavity 27 in the expandable portion 14 may be separated from the storage cavity 26 in the insulated portion 12 by the common wall 22. A mesh net cover (not shown) may be provided to cover the storage compartment. The mesh net can be retracted and then pulled up over the top of the storage cavity to keep the items therein from falling out or moving excessively while the cooler is being transported.

A cooling system 32 may be provided to heat or cool the air in the storage cavity 26 and maintain items in storage cavity 26 at a desired temperature. The cooling system 32 may be coupled to the insulated portion 12 as shown in FIG. 1. The cooling system 32 may be any known cooling system, for example a known thermoelectric cooling system. An example of cooling systems that may be used are described in U.S. Pat. No. 6,724,011, which is incorporated herein by reference. The cooling system 32 may be powered by either AC or DC power. A power supply, such as a rechargeable battery may be disposed in the housing. Preferably, the cooling system includes a DC power cord that is adapted to plug directly into a 12V receptacle, such as a cigarette lighter plug adaptor, in a vehicle. Most modern minivans and SUVs include a 12V receptacle in their rear cargo area. The apparatus can thus easily be stored and operated in such vehicles. The DC power cord may also be used to recharge the battery via a recharging circuit in a known manner.

Also a power cord that is adapted to be plugged into a AC power supply, for example, a typical wall outlet. A power inverter (not shown) may be provided to convert the AC power into DC power or vise versa. The power inverter may also be used to provide a source of DC power for other devices or to recharge the battery.

The cooler 1 may also be provided with wheels and a retractable handle. The cooler 1 can be tilted to be easily transported by rolling on the wheels. In the illustrated embodiment a pair of wheels 34 (only one shown) may be disposed at the intersection of bottom 24 of the first section 3 with wall 18. The wheels 34 may be of any type. A handle 38 is also attached to the first section 3 (FIG. 4). As shown. the handle 38 extends from the first section 3 towards the second section 4, opposite from the wheels 34. The handle 38 may be a telescoping handle, similar to that commonly found on airline carry-on luggage. The handle 38 can be telescoped and locked in place to pull the cooler 1 on its wheels 34. The handle 38 may also be used to provide support for the expandable portion 14, as is described in more detail below.

The handle 38 includes a grip portion 56 by which a user can grip the handle 38 to transport the cooler. A pair of legs 58, 60 extend from the grip portion 56 to a base secured to the bottom 24 of the insulated portion 12. In the illustrated embodiment, the base includes a pair of brackets 63, 64 spaced apart and attached to the cooler 1. A housing portion 66 of the handle is secured in placed by the brackets 63, 64. The housing portion 66 receives the telescoping portions of the handle therein. The legs 58, 60 preferably are substantially parallel to each other and are positioned to support the bottom 48 of the expandable portion 14. Accordingly, the legs 58, 60 extend under the bottom 48 of the expandable portion 14 when the expandable portion 14 is in its expanded position as best seen in FIG. 4.

The handle may also be used to hold the expandable portion 14 in its expanding position. This may be done by securing the handle 38 to the end wall 40. For example, a bottom side 68 of the end wall 40 may be provided with a pair of slots 69, 70. The legs 58, 60 of the handle may be provided with tabs or hooks 72, 74 at one or more locations along their length. The hooks 72, 74 on the legs 58, 60 slide into the corresponding slots 69, 70 in the bottom side 68 of the end wall 40 to secure the expandable portion 14 in its expanded position. The handle 38 may be used to move the expandable portion 14 between the expanded and closed positions. The hooks 72, 74 on the legs 58, 60 fit into the slots 69, 70 such that the expandable portion 14 moves with the handle 38. The handle 38 may be locked into various positions at different telescopic extensions.

A strap may also be provided for the cooler. The strap may be used to transport the cooler, as well as to support the expandable portion. A first end 80 of a strap 82 is secured to wall 20 adjacent to the expandable portion 14. An anchor 86 is provided on wall 20 spaced apart from where first end 82 of the strap is secured. A second end 82 of the strap includes a clip 84 that is adapted to be received in anchor 86. An intermediate part 98 of the strap runs through a handle 90. The slack from the strap runs through the handle 90 so that the strap can be pulled tight or loosened depending upon the position of the expandable portion 14. A similar arrangement is provided for wall 16. When the expandable portion 14 is in the closed position, the excess slack from the strap is pulled tight and the clip 84 is locked in place into the anchor 86, as shown in FIG. 3. In this position, the straps help secure the expandable portion closed.

As best shown in FIG. 4, when the expandable portion 14 is in the expanded position, the strap extends along the walls 50, 52 of the expandable portion 14 and the clip 84 is adjacent to the handle 90. The strap helps to stabilize the contents in the storage cavity. Alternatively, the excess slack in the strap may be used as a shoulder strap when the expandable portion is in the closed position.

Figure 5:
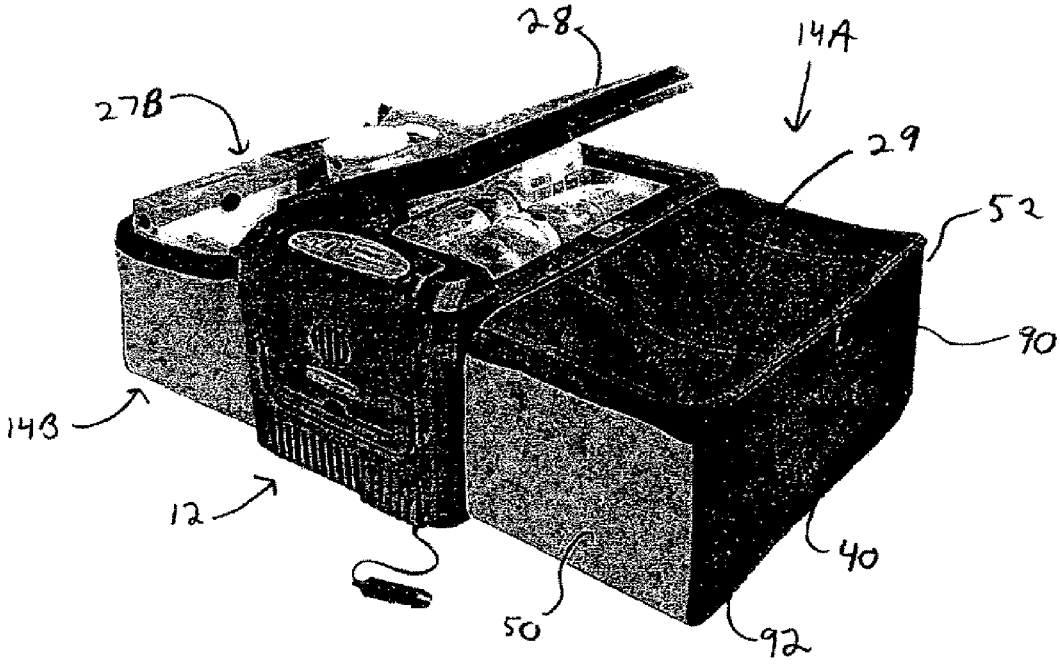
FIG. 5 depicts a further exemplary embodiment of an expandable cooler according to the present invention.

FIG. 5 illustrates another embodiment of the invention. In this embodiment, a plurality of expandable portions 14 are provided. The expandable portions 14A, B are attached to side walls of the insulated portion 12. The expandable portions 14A, B may use one of the side walls 16-22 to define the second storage space 27A, 27B or may include another wall disposed on an exterior of the side wall.

A separate lid maybe provided for each of the storage compartments. Lid 29 shown in this embodiment is preferably comprised of a soft material, such as nylon. The lid 29 may be attached to the insulated portion 12 and selectively cover the second storage compartments 27A, 27B. A zipper 90 may be provided to secure the lid 29 to the end wall 40 and side walls 50, 52. The lid 29 may also be used to hold the expandable portion 14 in the closed position. A fastener 92, such as a Velcro patch, may be provided on the lid 29 and the end wall 40. When the expandable portion 14 is in the closed position, the lid 29 may fold down over the end wall 40. The fasteners on the lid 29 and end wall 40 mate to hold the expandable portion 14 closed.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

I claim:

1. An expandable storage device, comprising:

a housing defining a first storage compartment being at least partially insulated;

an expandable housing adjacent to the housing and having an end wall, the expandable housing defining a second storage compartment when in an expanded position;

a common wall separating the first storage compartment from the second storage compartment, the expandable housing being movable between a closed position in which the end wall of the expandable housing is adjacent the common wall and the expanded position in which the end wall of the expandable housing is positioned away from the common wall with respect to the closed position.

2. The expandable storage device of claim 1, wherein the expandable housing comprises:

an end wall; and at least two side walls arranged opposite each other and having first second ends and, the first ends end connected to the common wall and the second ends connected to the end wall to partially define the second storage compartment.

3. The expandable storage device of claim 1, further comprising dividers dividing the second storage compartment into a plurality of compartments.

4. The expandable storage device of claim 2, wherein in the closed position the side walls are compressed towards the common wall with respect to the expanded position.

5. The expandable storage device of claim 4, wherein the side walls are comprised of a pliable material.

6. The expandable storage device of claim 5, wherein the side walls are adapted to fold accordion style when the expandable housing is moved to the closed position.

7. The expandable storage device of claim 1, further comprising a thermoelectric device in communication with the first storage compartment to heat or cool air in the first storage compartment.

8. The expandable storage device of claim 1, further comprising a lid to selectively cover the first storage compartment.

9. The expandable storage device of claim 2, further comprising a bottom connected to the side walls of the expandable housing; and an extendible handle arranged adjacent to the bottom, the handle being moveable between an extendible and a closed position.

10. The expandable storage device of claim 9, wherein the handle extends along the bottom when the expandable portion is in the expanded position and the handle is in the extendible position.

11. The expandable storage device of claim 9, wherein the handle comprises:

a grip;

legs having first ends coupled to the housing and second ends coupled to the grip;

a protrusion disposed on at least one of the legs;

a recess defined in the end wall and adapted to receive the protrusion, the protrusion adapted to engage the recess to couple the end wall to the handle.

12. The expandable storage device of claim 11, whereby the expandable portion may be moved between the open and closed position via the handle.

13. The expandable storage device of claim 11, wherein the protrusion comprises tabs on the legs and the recess comprises a corresponding slot in the end wall, the tabs engaging the slot to hold the expandable portion in the expanded position.

14. The expandable storage device of claim 1, further comprising wheels disposed on a bottom of the housing.

15. An expandable storage device, comprising:

a housing having a hard shell defining an insulated compartment, the housing including first and second sections that are movable apart from each other;

side walls extending between the first and second sections of the housing;

a bottom connected to the side walls, the side walls and the bottom defining a second compartment disposed between the two sections of the housing, the side walls adapted to collapse when the first and section sections of the housing are moved towards each other.

16. The expandable storage device of claim 15, wherein the first section of the housing comprises a bottom and four walls extending from the bottom to define the insulated compartment.

17. The expandable storage device of claim 15, further comprising a lid to selectively cover the insulated compartment.

18. The expandable storage device of claim 16, wherein one of the walls is a common wall between the insulated compartment and the second compartment and the side walls extend from opposite ends of the common wall.

19. The expandable storage device of claim 15, further comprising a thermoelectric unit coupled to the housing, the thermoelectric unit adapted to heat or cool items in the insulated compartment.

20. The expandable storage device of claim 19, further comprising a battery coupled to the thermoelectric unit.

21. The expandable storage device of claim 20, further comprising a recharging circuit coupled to the battery to recharge the battery.

22. The expandable storage device of claim 20, further comprising a power inverter disposed in the housing, the power inverter coupled to the battery to recharge the battery.

23. An expandable storage device, comprising:

a bottom having a plurality of side edges;

insulated side walls extending in the same direction from the side edges of the bottom, the insulated side walls immediately adjacent to each other being connected together to define a first storage compartment with the bottom;

an end wall;

at least two expandable walls arranged opposite each other and extending from one of the side walls to the end wall;

a bottom connected to the expandable walls and the end wall to define a second storage compartment, the end wall being movable with respect to the side walls.

24. The expandable storage device of claim 23, wherein the end wall is comprised of an end section arranged substantially parallel to the one side wall.

25. The expandable storage device of claim 24, the end wall being disposed adjacent to the one side wall when the end wall is in a closed position.

* * * * *